US006102102A

United States Patent [19]

Harrington

[11] Patent Number: 6,102,102

[45] **Date of Patent: *Aug. 15, 2000**

[54] METHOD AND APPARATUS FOR CONTINUOUS CASTING OF METALS

[75] Inventor: Donald G. Harrington, Danville, Calif.

[73] Assignee: Kaiser Aluminum & Chemical Corporation, Pleasanton, Calif.

[ * ] Notice: This patent is subject to a terminal disclaimer.

[21] Appl. No.: 08/799,448

[22] Filed: Feb. 13, 1997

Related U.S. Application Data

[63] Continuation of application No. 08/184,581, Jan. 21, 1994, abandoned, which is a continuation of application No. 07/902,997, Jun. 23, 1992, abandoned.

[51] Int. Cl.[7] ..... B22D 11/06

[52] U.S. Cl. ..... 164/481; 164/432; 164/443; 164/485

[58] Field of Search ..... 164/485, 481, 164/479, 443, 432, 431, 429

[56] References Cited

U.S. PATENT DOCUMENTS

| | | | |
|---|---|---|---|
| 2,348,178 | 5/1944 | Merle | 164/479 |
| 2,904,860 | 9/1959 | Hazelett | 164/481 |
| 3,193,888 | 7/1965 | Rochester | 164/432 |
| 3,432,293 | 3/1969 | Michael | 164/481 |
| 3,502,448 | 3/1970 | Anderson et al. . | |
| 3,795,269 | 3/1974 | Leconte et al. . | |
| 3,933,193 | 1/1976 | Baker et al. . | |
| 4,061,177 | 12/1977 | Sivilotti . | |
| 4,061,178 | 12/1977 | Sivilotti et al. . | |
| 4,193,440 | 3/1980 | Thorburn et al. | 164/432 |
| 4,586,559 | 5/1986 | Govaerts | 164/481 |
| 4,614,224 | 9/1986 | Jeffrey et al. | 164/476 |
| 4,632,176 | 12/1986 | Pearce | 164/481 |
| 4,793,401 | 12/1988 | Matsuoka et al. | 164/476 |
| 4,817,702 | 4/1989 | Itoyama et al. | 164/432 |
| 4,895,202 | 1/1990 | Sato et al. | 164/430 |
| 5,515,908 | 5/1996 | Harrington | 164/481 |
| 5,564,491 | 10/1996 | Harrington | 164/481 |

FOREIGN PATENT DOCUMENTS

| | | | |
|---|---|---|---|
| 0084335 | 7/1983 | European Pat. Off. . | |
| 0181566 | 5/1986 | European Pat. Off. . | |
| 0504999 | 9/1992 | European Pat. Off. . | |
| 2740477 | 3/1978 | Germany . | |
| 61-176448 | 8/1986 | Japan . | |
| 62-77159 | 4/1987 | Japan . | |
| 1-249250 | 10/1989 | Japan . | |
| 0254517 | 7/1926 | United Kingdom | 164/432 |

OTHER PUBLICATIONS

Ingot and Continuous Casting Process Technology—Seminar for flat rolled products; Leone, Proceedings of the Aluminum Association, vol. II, May 10, 1989.

*Primary Examiner*—J. Reed Batten, Jr.
*Attorney, Agent, or Firm*—Keith V. Rockey; Philip L. McGarrigle

[57] ABSTRACT

A metal strip is continuously cast between a pair of heat conductive endless belts which serve to form a molding zone to solidify molten metal. The endless belts remove heat from the molten metal and are cooled when the belts are not in contact with the molten metal, which minimizes belt distortion.

19 Claims, 4 Drawing Sheets

FIG. 3
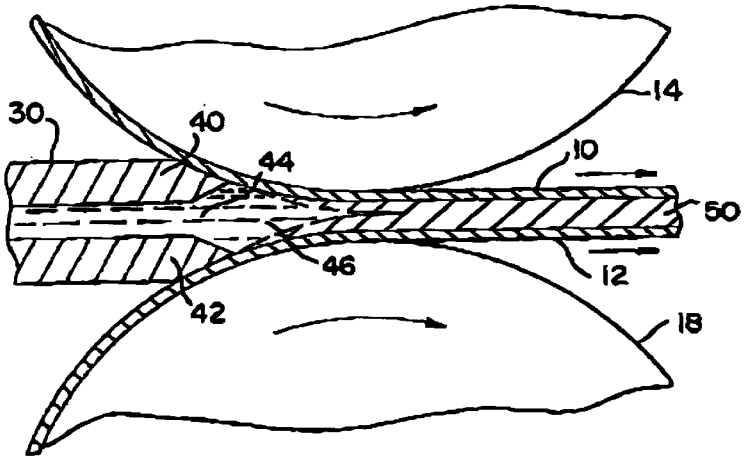
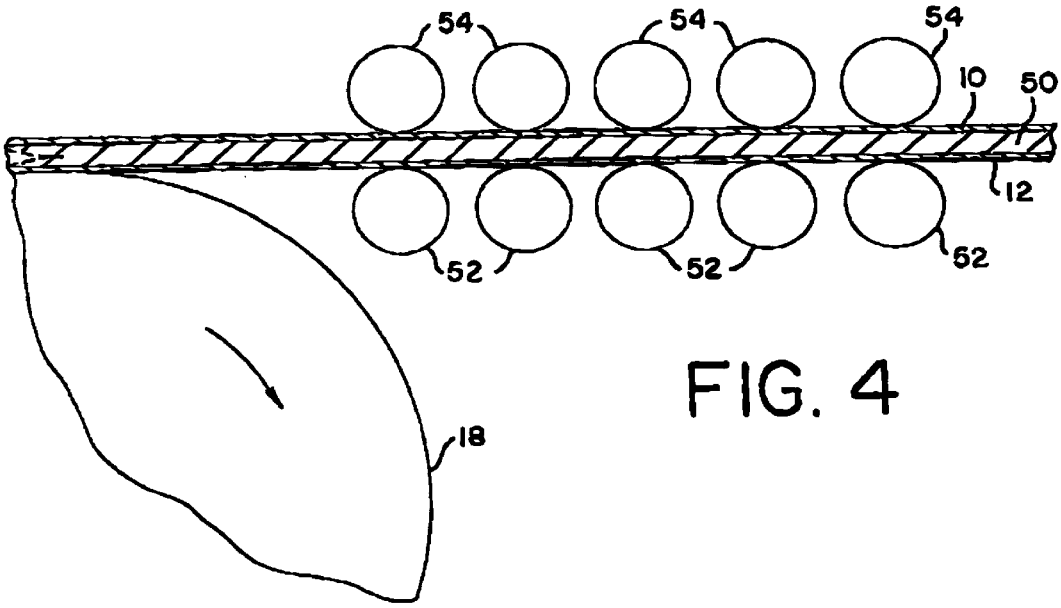
FIG. 4
FIG. 5
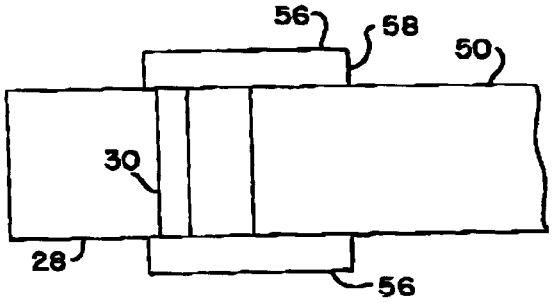

METHOD AND APPARATUS FOR CONTINUOUS CASTING OF METALS

This application is a continuation of application(s) Ser. No. 08/184,581 filed on Jan. 21, 1994 which is a continuation of application Ser. No. 07/902,997 filed on Jun. 23, 1992, both now abandoned.

BACKGROUND OF THE INVENTION

This invention relates to a method and apparatus for the continuous casting of metals, and particularly the casting of metal strip.

The continuous casting of thin metal strip has been employed with only limited success. By and large, prior processes for the continuous casting of metal strip have been limited to a relatively small number of alloys and products. It has been found that as the alloy content of various metals are increased, as-cast surface quality deteriorates. As a result, many alloys must be fabricated using ingot methods.

In the case of aluminum, relatively pure aluminum product such as foil can be continuously strip cast on a commercial basis. Building products can likewise be continuously strip cast, principally because surface quality in the case of such building products is less critical than in other aluminum products, such as can stock. However, as the alloy content of aluminum is increased, surface quality problems appear, and strip casting has generally been unsuitable for use in making many aluminum alloy products.

A number of strip casting machines have been proposed in the prior art. One conventional device is a twin belt strip casting machine, but such machines have not achieved widespread acceptance in the casting of many metals, and particularly metal alloys with wide freezing ranges. In such twin belt strip casting equipment, two moving belts are provided which define between them a moving mold for the metal to be cast. Cooling of the belts is typically effected by contacting a cooling fluid with the side of the belt opposite the side in contact with the molten metal. As a result, the belt is subjected to extremely high thermal gradients, with molten metal in contact with the belt on one side and a water coolant, for example, in contact with the belt on the other side. The dynamically unstable thermal gradients cause distortion in the belt, and consequently neither the upper nor the lower belt is flat. The product thus produced has areas of segregation and porosity as described below.

Leone, in the *Proceedings Of The Aluminum Association, Ingot and Continuous Casting Process Technology Seminar For Flat Rolled Products,* Vol. II, May 10, 1989, said that severe problems develop if belt stability and reasonable heat flow are not achieved. In the first place, if any area of the belt distorts after solidification of the molten metal has begun and strip shell coherency has been reached, the resulting increase in the gap between the belt and the strip in the distorted region will cause strip shell reheating, or, at least, a locally reduced shell growth rate. That, in turn, gives rise to inverse segregation in the strip which generates interdendritic eutectic exudates at the surface. Moreover, in severe cases with medium and long freezing range alloys, liquid metal is drawn away from a distorted region to feed adjacent, faster solidifying portions of the strip. That in turn causes the surface of the strip to collapse and forms massive areas of shrinkage porosity in the strip which can crack on subsequent rolling or produce severe surface streaks on the rolled surface.

As a result, twin belt casting processes have not generally achieved acceptance in the casting of alloys for surface-critical applications, such as the manufacturing of can stock. Various improvements have been proposed in the prior art, including preheating of the belts as described in U.S. Pat. Nos. 3,937,270 and 4,002,197, continuously applied and removed parting layers as described in U.S. Pat. No. 3,795,269, moving endless side dams as described in U.S. Pat. No. 4,586,559 and improved belt cooling as described in U.S. Pat. Nos. 4,061,177, 4,061,178 and 4,193,440. None of those techniques has achieved widespread acceptance either.

Another continuous casting process that has been proposed in the prior art is that known as block casting. In that technique, a number of chilling blocks are mounted adjacent to each other on a pair of opposing tracks. Each set of chilling blocks rotates in the opposite direction to form therebetween a casting cavity into which a molten metal such as an aluminum alloy is introduced. The liquid metal in contact with the chilling blocks is cooled and solidified by the heat capacity of the chilling blocks themselves. Block casting thus differs both in concept and in execution from continuous belt casting. Block casting depends on the heat transfer which can be effected by the chilling blocks. Thus, heat is transferred from the molten metal to the chilling blocks in the casting section of the equipment and then extracted on the return loop. Block casters thus require precise dimensional control to prevent flash (i.e. transverse metal fins) caused by small gaps between the blocks. Such flash causes sliver defects when the strip is hot rolled. As a result, good surface quality is difficult to maintain. Examples of such block casting processes are set forth in U.S. Pat. Nos. 4,235,646 and 4,238,248.

Another technique which has been proposed in continuous strip casting is the single drum caster. In single drum casters, a supply of molten metal is delivered to the surface of a rotating drum, which is internally water cooled, and the molten metal is dragged onto the surface of the drum to form a thin strip of metal which is cooled on contact with the surface of the drum. The strip is frequently too thin for many applications, and the free surface has poor quality by reason of slow cooling and micro-shrinkage cracks. Various improvements in such drum casters have been proposed. For example, U.S. Pat. Nos. 4,793,400 and 4,945,974 suggest grooving of the drums to improve surface quality; U.S. Pat. No. 4,934,443 recommends a metal oxide on the drum surface to improve surface quality. Various other techniques are proposed in U.S. Pat. Nos. 4,979,557, 4,828,012, 4,940,077 and 4,955,429.

Another approach which has been employed in the prior art has been the use of twin drum casters, such as in U.S. Pat. Nos. 3,790,216, 4,054,173, 4,303,181, or 4,751,958. Such devices include a source of molten metal supplied to the space between a pair of counter-rotating, internally cooled drums. The twin drum casting approach differs from the other techniques described above in that the drums exert a compressive force on the solidified metal, and thus effect hot reduction of the alloy immediately after freezing. While twin drum casters have enjoyed the greatest extent of commercial utilization, they nonetheless suffer from serious disadvantages, not the least of which is an output typically ranging about 10% of that achieved in prior art devices described above. Once again, the twin drum casting approach, while providing acceptable surface quality in the casting of high purity aluminum (e.g. foil), suffers from poor surface quality when used in the casting of aluminum with high alloy content and wide freezing range. Another problem encountered in the use of twin drum casters is centerline segregation of the alloy due to deformation during solidification.

There is thus a need to provide an apparatus and method for continuously casting thin metallic strip at high speeds and improved surface quality as compared to methods currently employed.

It is accordingly an object of the present invention to provide an apparatus and method for continuously casting thin metallic strip at high speeds which overcome the foregoing deficiencies.

It is a more specific object of the invention to provide an apparatus and method for the continuous casting of thin metallic strip which provides improved surface quality even when processing metals such as aluminum with high alloy content.

These and other objects and advantages of the invention appear more fully hereinafter from a detailed description of the invention.

SUMMARY OF THE INVENTION

The concepts of the present invention reside in a method and apparatus for continuous strip casting of metals utilizing a twin belt strip casting approach in which the belts are each cooled in an outer loop when the belt is out of contact with the molten metal. Unlike the prior art approach to twin belt strip casting, the present invention utilizes the heat sink capacity of the belts in casting of the molten metal. In that way, the method and apparatus of the present invention minimize or avoid the erratic distortion effects caused by high non-uniform thermal gradients across twin belt strip casters of the prior art.

The concepts of the present invention can be employed in the strip casting of most metals, including steel, copper, zinc and lead, but are particularly well suited to the casting of thin aluminum alloy strip, while overcoming the problems of the prior art.

BRIEF DESCRIPTION OF THE DRAWINGS

FIG. 3 is a cross-sectional view of the entry of molten metal to the apparatus illustrated in FIGS. 1 and 2.

FIG. 4 is a detailed view of the mechanism supporting the belts in the apparatus of FIGS. 1 and 2.

FIG. 5 is a top view illustrating one embodiment of the edge containment means employed in the practice of the invention.

DETAILED DESCRIPTION OF THE INVENTION

Figure 1:
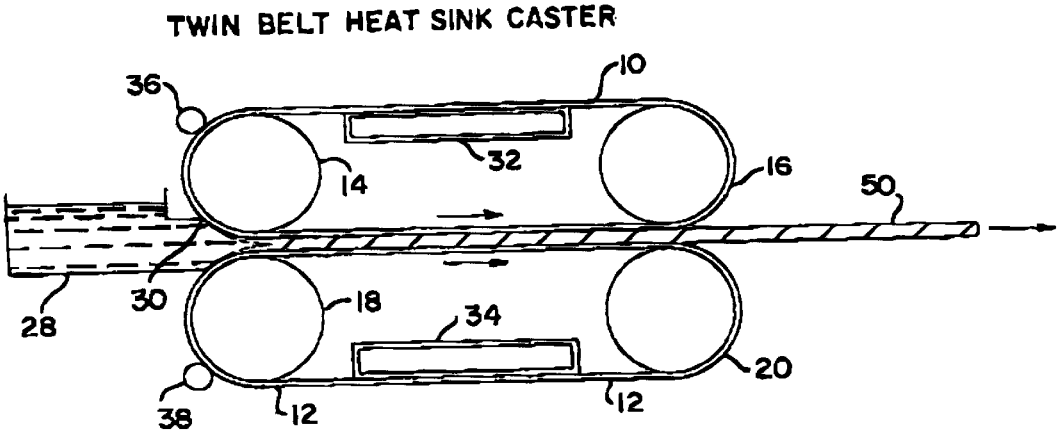
FIG. 1 is a schematic illustration of the casting method and apparatus embodying the present invention.
Figure 2:
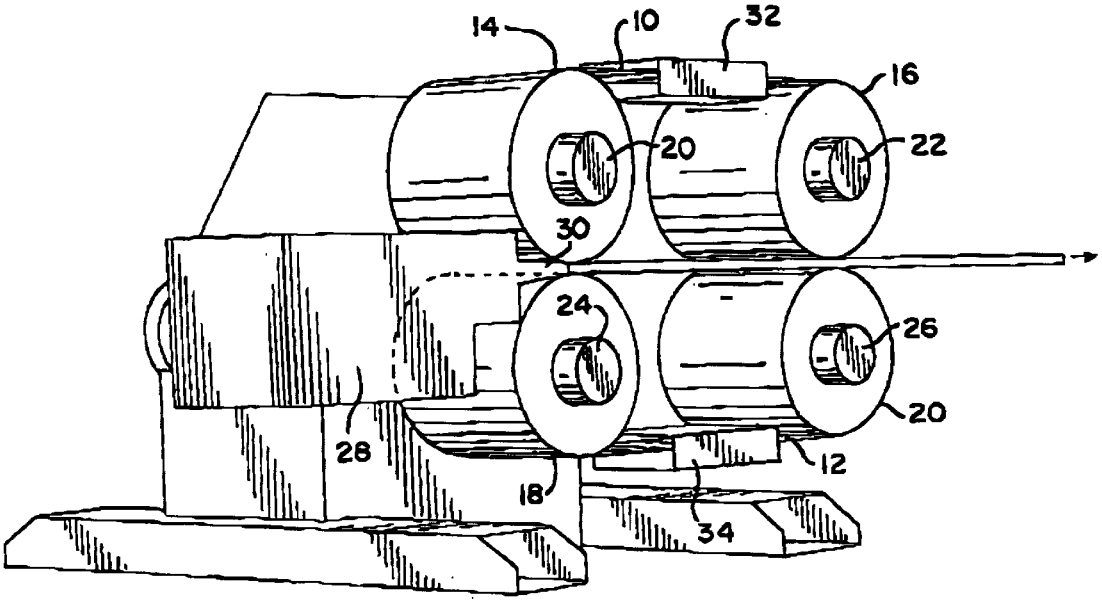
FIG. 2 is a perspective view of one casting apparatus embodying the invention.

The apparatus employed in the practice of the present invention is perhaps best illustrated in FIGS. 1 and 2 of the drawings. As there shown, the apparatus includes a pair of endless belts 10 and 12 carried by a pair of upper pulleys 14 and 16 and a pair of corresponding lower pulleys 18 and 20 of FIG. 1. Each pulley is mounted for rotation about an axis 21, 22, 24, and 26 respectively of FIG. 2. The pulleys are of a suitable heat resistant type, and either or both of the upper pulleys 14 and 16 is driven by a suitable motor means not illustrated in the drawing for purposes of simplicity. The same is equally true for the lower pulleys 18 and 20. Each of the belts 10 and 12 is an endless belt, and is preferably formed of a metal which has low or non-reactive with the metal being cast. Quite a number of suitable metal alloys may be employed as well known by those skilled in the art. Good results have been achieved using steel and copper alloy belts.

The pulleys are positioned, as illustrated in FIGS. 1 and 2, one above the other with a molding gap therebetween. In the preferred practice of the invention, the gap is dimensioned to correspond to the desired thickness of the metal strip being cast.

Molten metal to be cast is supplied to the molding gap through suitable metal supply means 28 such as a tundish. The inside of tundish 28 corresponds in width to the width of the belts 10 and 12 and includes a metal supply delivery casting nozzle 30 to deliver molten metal to the molding gap between the belts 10 and 12. Such tundishes are conventional in strip casting.

In accordance with the concepts of the invention, the casting apparatus of the invention includes a pair of cooling means 32 and 34 positioned opposite that portion of the endless belt in contact with the metal being cast in the molding gap between belts 10 and 12. The cooling means 32 and 34 thus serve to cool the belts 10 and 12 just after they pass over pulleys 16 and 20, respectively, and before they come into contact with the molten metal. In the most preferred embodiment as illustrated in FIGS. 1 and 2, the coolers 32 and 34 are positioned as shown on the return run of belts 10 and 12, respectively. In that embodiment, the cooling means 32 and 34 can be conventional cooling means such as fluid cooling nozzles positioned to spray a cooling fluid directly on the inside and/or outside of belts 10 and 12 to cool the belts through their thicknesses. In that preferred embodiment, it is sometimes desirable to employ scratch brush means 36 and 38 which frictionally engage the endless belts 10 and 12, respectively, as they pass over pulleys 14 and 18 to clean any metal or other forms of debris from the surface of the endless belts 10 and 12 before they receive molten metal from the tundish 28.

Thus, in the practice of the invention, molten metal flows from the tundish through the casting nozzle 30 into the casting zone defined between the belts 10 and 12 and the belts 10 and 12 are heated by means of heat transfer from the cast strip to the metal of the belts 10 and 12. The cast metal strip remains between the casting belts 10 and 12 until each of them is turned past the centerline of pulleys 16 and 20. During that return loop, the cooling means 32 and 34 cool the belts 10 and 12, respectively, and substantially remove therefrom the heat transferred to the belts by means of the molten metal as it solidified. After the belts are cleaned by the scratch brush means 36 and 38 while passing over pulleys 14 and 18, they approach each other to once again define a casting zone.

While the cooling means 32 and 34 are positioned into the preferred embodiment of the invention on the return loop of the casting belts, it should be understood by those skilled in the art that the cooling means can be positioned at any point after the belt ceases to be in contact with the metal strip being cast and before the belt comes in contact with fresh molten metal as it completes the return loop. The concepts of the present invention contemplate a method and apparatus in which the heat transferred to the metal belt during strip casting is removed therefrom while the casting belt is out of contact with the metal strip being cast. Thus, the cooling means can be positioned, if desired, adjacent to pulleys 16 or 20 or adjacent pulleys 14 or 18 so long as they remove from the belt the heat transferred to the belt during the casting operation when the belt is out of contact with the metal being cast.

The supply of molten metal from the tundish through the casting nozzle 30 is shown in greater detail in FIG. 3 of the drawings. As is shown in that figure, the casting nozzle 30 is formed of an upper wall 40 and a lower wall 42 defining a central opening 44 therebetween whose width extends substantially over the width of the belts 10 and 12 as they pass around pulleys 14 and 18, respectively.

The distal ends of the walls 40 and 42 of the casting nozzle 30 are in substantial proximity to the surface of the casting belts 10 and 12, respectively, and define with the belts 10 and 12 a casting cavity 46 into which the molten metal flows through the central opening 44. As the molten metal in the casting cavity 46 flows between the belts 10 and 12, it transfers its heat to the belts 10 and 12, simultaneously cooling the molten metal to form a solid strip 50 maintained between casting belts 10 and 12.

Figure 8:
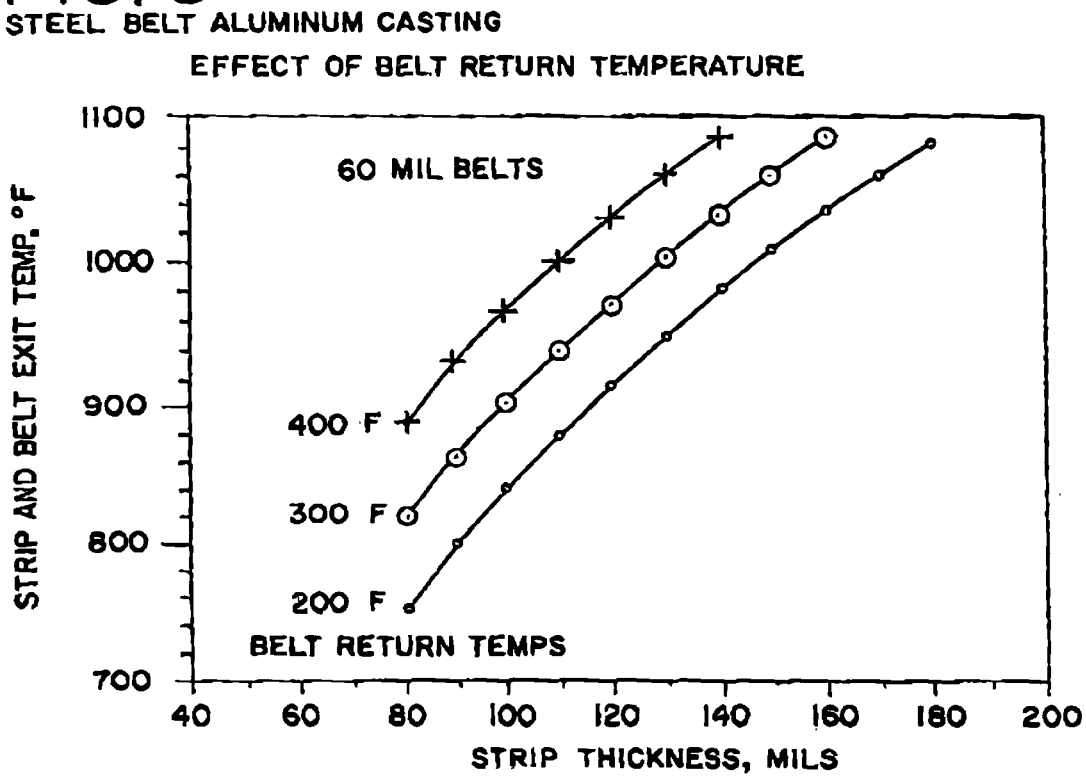
FIG. 8 is graph illustrating the relationship of strip and belt exit temperature with strip thickness and belt return temperature.
Figure 7:
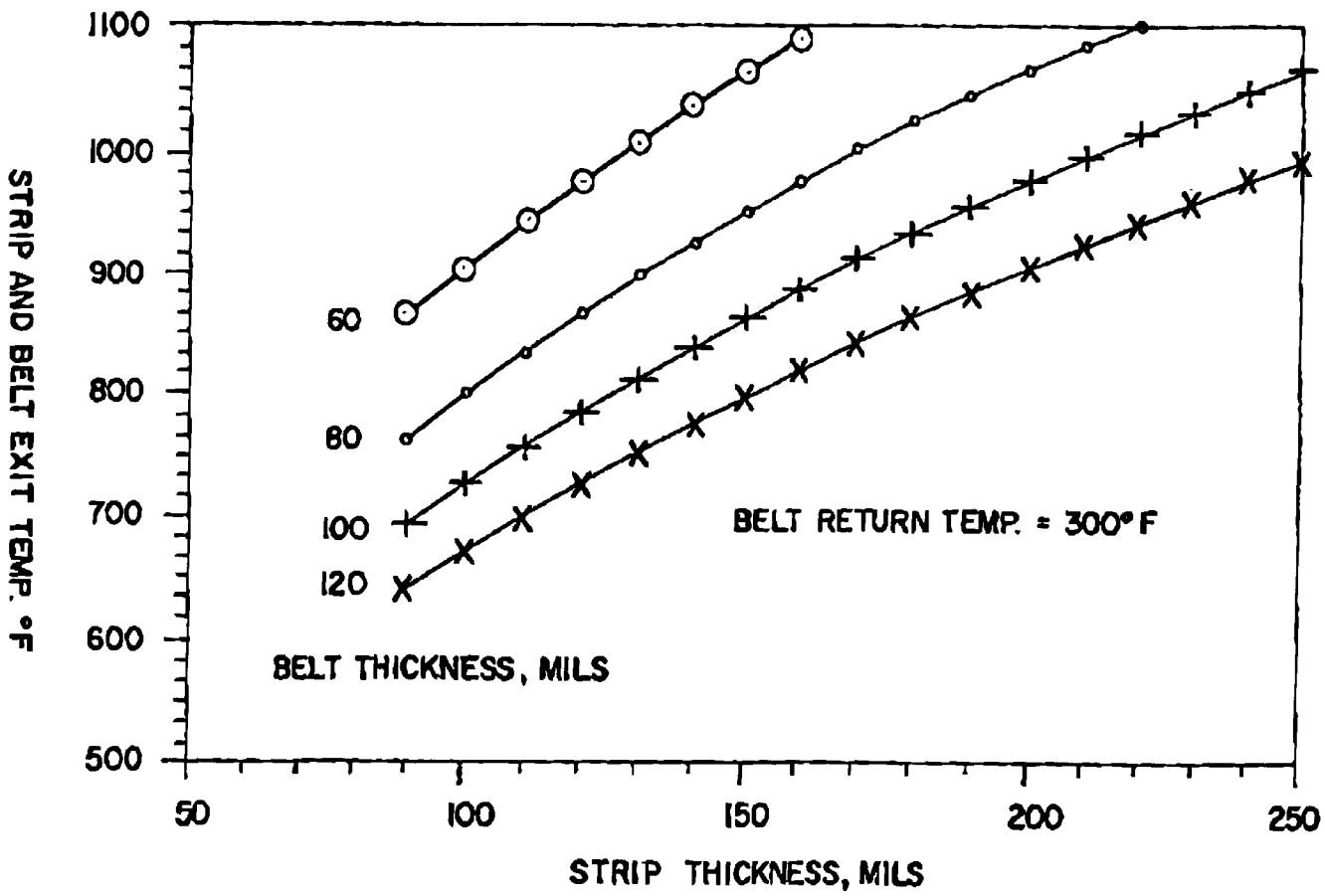
FIG. 7 is a graph illustrating the relationship between the strip exit temperature with belt and strip thickness.

The thickness of the strip that can be cast is, as those skilled in the art will appreciate, related to the thickness of the belts 10 and 12, the return temperature of the casting belts and the exit temperature of the strip and belts. In addition, the thickness of the strip depends also on the metal being cast. It has been found that aluminum strip having a thickness of 0.100 inches using steel belts having a thickness of 0.08 inches provides a return temperature of 300° F. and an exit temperature of 800° F. The interrelationship of the exit temperature with belt and strip thickness is shown in FIG. 7 of the drawings, while the interrelationship of strip and belt exit temperature with strip thickness and belt thickness is shown in FIG. 8 of the drawings. For example, for casting aluminum strip for a thickness of 0.100 using a steel belt having a thickness of 0.06 inches, the exit temperature is 900° F. when the return temperature is 300° F. and the exit temperature is 960° F. when the return temperature is 400° F.

One of the advantages of the method and apparatus of the present invention is that there is no need to employ a thermal barrier coating on the belts to reduce heat flow and thermal stress, as is typically employed in the prior art. The absence of fluid cooling on the back side of the belt while the belt is in contact with hot metal in the molding zone significantly reduces thermal gradients and eliminates problems of film boiling occurring when the critical heat flux is exceeded. The method and apparatus of the present invention also minimizes cold framing, a condition where cold belt sections exist in three locations of (1) before metal entry and (2) on each of the two sides of mold zone of the belt. Those conditions can cause severe belt distortion.

In the preferred practice of the present invention, the belts 10 and 12 are supported at least in the first portion of the molding zone by a plurality of pulleys positioned to maintain both belts in a manner to ensure that the belts are substantially flat. That is illustrated in FIG. 4 of the drawings which illustrates the pulley 18 and the belts 10 and 12 as they face each other to define a mold cavity defining the solid strip 50. The lower pulleys 52 thus support the belt 12 as it passes over pulley 18. As shown in FIG. 4, each of those pulleys is mounted for rotation about an axis parallel to and extending transversely beneath belt 12 to maintain the belt in a substantially flat configuration, and thus assist in supporting both the weight of the belt and the weight of the metal strip 50 being cast.

A corresponding set of pulleys 54 are mounted in tangential contact with the upper belt 10 and thus serve to exert sufficient pressure on the belt 10 to maintain the belt 10 in contact with the strip 50 as it is transformed from molten metal to a solid strip.

In accordance with another embodiment of the invention, it is sometimes desirable to provide means along the respective edges of the belts to contain the metal and prevent it from flowing outwardly in a transverse direction from the belt. It is accordingly possible to use a conventional edge dam for that purpose such as used on twin drum casting machines. A suitable edge dam is illustrated in FIG. 5 of the drawings showing a pair of edge dam members 56 which are positioned adjacent to the edge of belts 10 and 12. The edge dam members 56 are composed of a pair of walls extending substantially perpendicularly from the surfaces of the belts 10 and 12 to prevent the flow of molten metal outwardly from the molding zone defined between the belts. For that purpose, the edge dam elements 56 have a leading edge 58 which is mounted forward of the casting nozzle 30 so that molten metal supplied by the casting nozzle 30 is confined between the belts 10 and 20 and the opposing edge dam elements 56. As will be appreciated by those skilled in the art, other edge dams can likewise be used in the practice of the invention.

Figure 6:
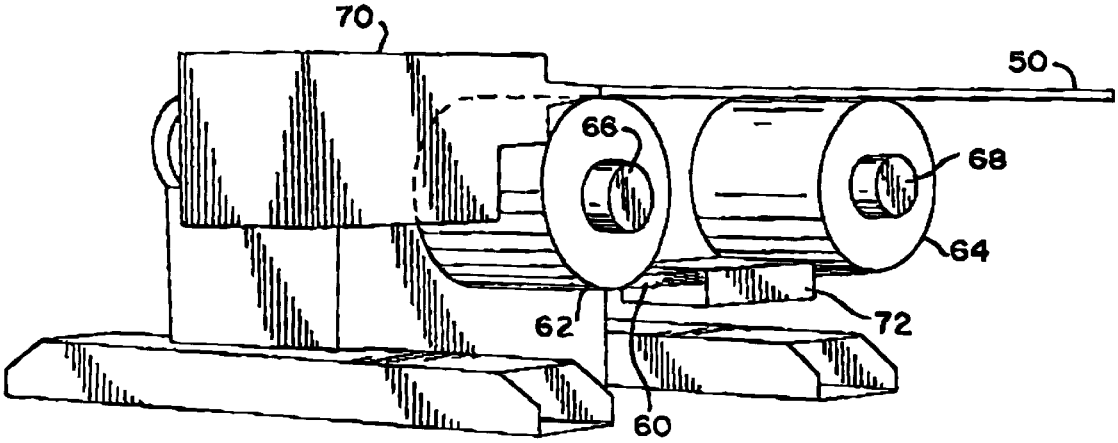
FIG. 6 is a perspective view of an alternative embodiment of the invention.

In accordance with another embodiment of the present invention, it is also possible to employ the concepts of the present invention in a method and apparatus utilizing a single belt. That embodiment is schematically illustrated in FIG. 6 of the drawings. In that embodiment, a single belt 60 is mounted on a pair of pulleys 62 and 64, each of which is mounted for rotation about an axis 66 and 68, respectively. Molten metal is supplied to the surface of the belt by means of a tundish 70. Cast product 60 exits the top surface of belt. As is the case with the embodiment illustrated in FIGS. 1 and 2, the ultimate embodiment of FIG. 6 utilizes cooling means 72, preferably positioned on the return of the belt. The cooling means 72, like that of cooling means 34 in FIG. 1, serves to cool the belt when it is not in contact with the molten metal on the belt 60.

It will be understood that various changes and modifications can be made in the details of structure configuration and use without departing from the spirit of the invention, especially as defined in the following claims.

What is claimed is:

1. Apparatus for strip casting of metals by continuous belt casting comprising:

(a) a pair of continuous, endless belts formed of a heat conductive material, said belts positioned adjacent each other to define a molding zone there between and each belt being carried on a plurality of pulleys, said belts each being adapted to be continuously advanced over said pulleys and each defining a cooling zone separate from the molding zone;

(b) means for supplying to the molding zone formed between the belts a molten metal whereby the molten metal is solidified between the belts in the molding zone to form a strip of cast metal and thereby transferring heat from the molten metal and the cast metal to the belts increasing their temperature; and, (c) cooling means positioned adjacent to the belts for cooling the belts when the belts are not in contact with either the molten metal or the cast metal, said cooling means serving to reduce the temperature of the belts by removing, when the belts are not in contact with either the metal or the cast strip, substantially all of the heat transferred by the molten metal and the cast metal to the belts.

2. Apparatus as defined in claim 1 wherein each belt is carried on a pair of pulleys, each mounted for rotation.

3. Apparatus as defined in claim 1 which includes means for advancing each of said belts about the pulleys.

4. Apparatus as defined in claim 1 wherein the means for supplying molten metal includes tundish means having a substantially horizontal nozzle means positioned to deposit molten metal in the molding zone between the belts.

5. Apparatus as defined in claim 1 wherein the cooling means includes means for applying a cooling fluid on the endless belts.

6. Apparatus as defined in claim 1 wherein the endless belts are formed of a heat conductive metal.

7. An apparatus as defined in claim 1 which includes edge containment means to prevent flow of molten metal beyond the edges of said belts.

8. Apparatus for strip casting of metals by continuous belt casting comprising:

(a) a pair of continuous, endless substantially horizontal belts formed of a heat conductive material and positioned adjacent each other to define a molding zone there between, each of said belts carried on a plurality of pulleys and each being adapted to being continuously advanced over said pulleys, with each belt defining a cooling zone separate from the molding zone;

(b) means for advancing each of said belts from the cooling zones to the molding zone by passing each of said belts at least partially around at least one of the pulleys to the molding zone;

(c) tundish means for supplying to the molding zone between the belts a molten metal whereby molten metal is deposited in the molding zone between the belts and is solidified in the molding zone to form a strip of cast metal conveyed out of the molding zone between the belts, thereby transferring heat from the molten metal and the cast metal to each of the belts increasing their temperature; and, (d) cooling means positioned adjacent to the belts for cooling the belts when the belts are not in contact with either the molten metal or the cast metal, said cooling means serving to reduce the temperature of the belts by removing, when the belts are not in contact with either the metal or the cast strip, substantially all of the heat transferred by the molten metal and the cast metal to the belts.

9. Apparatus as defined in claim 8 wherein each of the belts is substantially free from any thermal barrier coating on the surfaces thereof.

10. Apparatus for strip casting of metals by continuous belt casting comprising:

(a) a pair of continuous, endless belts formed of a heat conductive material, said belts positioned adjacent each other to define a molding zone there between and each belt being carried on a plurality of pulleys, said belts each being adapted to be continuously advanced over said pulleys;

(b) means for supplying a molten metal to the molding zone whereby the molten metal is solidified to form a strip of cast metal; and, (c) cooling means positioned adjacent to the belts for cooling the belts when the belts are not in contact with either the molten metal or the cast metal, said cooling means serving to reduce the temperature of the belts by removing, when the belts are not in contact with either the metal or the cast strip, substantially all of the heat transferred by the molten metal and the cast metal to the belt.

11. Apparatus for strip casting of metals by continuous belt casting comprising:

(a) a pair or continuous, endless substantially horizontal belts formed of a heat conductive material and positioned adjacent each other to define a molding zone there between, each of said belts being carried on a plurality of pulleys and each belt being adapted to being continuously advanced over said pulleys, with each belt defining a cooling zone separate from the molding zone;

(b) means for advancing each of said belts from the cooling zones to the molding zone by passing each of said belts at least partially around at least one of the pulleys to the molding zone;

(c) tundish means for supplying a molten metal to the molding zone which molten metal is solidified to form a strip of cast metal; and, (d) cooling means positioned adjacent to the belts for cooling the belts when the belts are not in contact with either the molten metal or the cast metal, said cooling means serving to reduce the temperature of the belts by removing substantially all of the heat transferred by the molten metal and the cast metal to the belt when the belts are not in contact with either the metal or the cast strip.

12. A method for the casting of metals by continuous belt casting comprising the steps of moving a pair of endless belts positioned adjacent to each other and defining a molding zone there between, depositing in the molding zone between the belts a molten metal whereby the molten metal solidifies in the molding zone to form a strip of cast metal while transferring heat from each of the belts to increase their temperature and cooling each of the belts to remove the heat transferred to them from the molten metal and cast metal when the belts are not in contact with the molten metal and before the belts receives additional molten metal.

13. A method as defined in claim 12 wherein each of the belts is substantially free from any thermal barrier coating on the surfaces thereof.

14. A method for the casting of metals by continuous belt casting comprising the steps of moving a pair of endless substantially horizontal belts formed of a heat conductive material over a pulley to form a molding zone between the belts, depositing in the molding zone a molten metal whereby the molten metal solidifies in the molding zone to form a strip of cast metal while transferring heat to the belts and cooling the belts to remove the heat transferred to the belts from the molten metal and the cast metal when the belts are not in contact with the molten metal or the cast metal and before the belts receives additional molten metal.

15. A method as defined in claim 14 wherein the molten metal is supplied in a substantially horizontal stream to the molding zone.

16. A method as defined in claim 14 wherein said metal is an aluminum alloy.

17. A method as defined in claim 14 which includes the step of conveying the strip of cast metal from the molding zone between the surfaces of the belts.

18. A method for the casting of metals by continuous belt casting comprising the steps of moving a pair of endless belts positioned adjacent to each other and defining a molding zone there between, depositing in the molding zone between the belts a molten metal which solidifies to form a strip of cast metal and cooling each of the belts to remove the heat transferred to them from the molten metal and cast metal when the belt is not in contact with the molten metal and before the belt receives additional molten metal.

19. A method for the casting of metals by continuous belt casting comprising the steps of moving a pair of endless substantially horizontal belts formed of a heat conductive material over a pulley to form a molding zone between the belts, depositing in the molding zone a molten metal which solidifies in the molding zone to form a strip of cast metal and cooling the belt to remove the heat transferred to the belt from the molten metal and the cast metal when the belt is not in contact with the molten metal or the cast metal and before the belt receives additional molten metal.

* * * * *